United States Patent [19]

Arai

[11] Patent Number: 4,660,608

[45] Date of Patent: Apr. 28, 1987

[54] METHOD AND APPARATUS FOR LOADING COSMETIC MATERIAL INTO A CONTAINER AND SOLIDIFYING SAID COSMETIC MATERIAL

[75] Inventor: Yasuo Arai, Tokyo, Japan

[73] Assignee: Yoshida Industry Co., Ltd., Tokyo, Japan

[21] Appl. No.: 786,309

[22] Filed: Oct. 10, 1985

[30] Foreign Application Priority Data

Nov. 21, 1984 [JP] Japan ..... 59-244525

[51] Int. Cl.[4] ..... B65B 1/26; B65B 1/24

[52] U.S. Cl. ..... 141/12; 141/129; 141/57; 141/98; 141/73; 141/80; 100/90; 100/37; 100/116

[58] Field of Search ..... 141/11, 12, 98, 69, 141/71, 1, 73, 80, 37, 57, 129; 53/436, 438, 527, 528; 100/90, 37, 104, 110, 116

[56] References Cited

U.S. PATENT DOCUMENTS

| | | | |
|---|---|---|---|
| 2,109,559 | 3/1938 | Wickert, Jr. | 100/116 X |
| 2,322,246 | 6/1943 | McLaughlin | 141/80 |
| 2,381,454 | 8/1945 | Huth | 53/527 X |
| 3,211,190 | 10/1965 | Vogt | 141/5 |
| 3,838,001 | 9/1974 | Greiner et al. | 100/110 X |
| 3,847,191 | 11/1974 | Aronson | 141/12 |
| 3,989,581 | 11/1976 | Kober et al. | 100/110 X |
| 4,549,584 | 10/1985 | Morin et al. | 141/73 |

*Primary Examiner*—Stephen Marcus
*Assistant Examiner*—Ernest G. Cusick
*Attorney, Agent, or Firm*—Wenderoth, Lind & Ponack

[57] ABSTRACT

Loading and solidifying of a cosmetic material is achieved by dripping a viscous cosmetic material into a container having a filter bottom, interposing a liquid absorbent membrance between the container and a presser, compressing the cosmetic material by the presser with the membrance interposed therebetween, and squeezing a solvent from the cosmetic material through the filter during such compression. A supporting block holds the container in position for it to be subjected to vacuum suction. The presser includes inner and outer pressing blocks and drives for moving the pressing blocks. The inner block is capable of fitting into the container to compress the cosmetic material, while the outer block abuts against the upper rim of the container.

11 Claims, 7 Drawing Figures

METHOD AND APPARATUS FOR LOADING COSMETIC MATERIAL INTO A CONTAINER AND SOLIDIFYING SAID COSMETIC MATERIAL

BACKGROUND OF THE INVENTION

This invention relates to an improvement of a method and apparatus for loading a cosmetic material into a shallow cup of a compact or other container and for solidifying the cosmetic material loaded therein.

A method and apparatus of this kind are disclosed in Japanese Patent Publication No. 57-60004. The method disclosed therein comprises the steps of mixing powder cosmetic material with a solvent to form viscous cosmetic material, injecting the viscous cosmetic material under a predetermined pressure into a container, and at the same time having the solvent in the cosmetic material absorbed into an absorbing material for solidifying the cosmetic material. This improves operation efficiency and the external appearance of the products considerably, when compared with the conventional method wherein powder cosmetic material is loaded into a container without using a solvent or with the method wherein cosmetic material dissolved in a solvent is poured into a container and left to solidify by evaporation of the solvent.

Specifically, the Japanese Patent Publication discloses the following method. A receptacle to be loaded with cosmetic material is held in position by a supporting block. The receptacle has holes formed through the bottom thereof or through the sides thereof for injection of cosmetic material, and when the receptacle is held in position by the supporting block, nozzles of the supporting block are directly fitted to the holes of the receptacle. A porous absorbent block is pressed against the upper surface of the receptacle. In this state, the viscous cosmetic material which is made by dissolving the powder cosmetic material in a solvent is injected into the receptacle under a predetermined pressure from the nozzles. The moment the nozzles start the injection, the porous absorbent block starts to absorb the solvent from the cosmetic material.

In the above method, the holes in the sides or the bottom of the receptacle are directly fitted to the nozzles of the supporting block, and the cosmetic material is then injected into the receptacle through these nozzles. This requires, however, that the holes must be formed in precise positions with accurate dimensions, and that the nozzles must be perfectly fitted to the holes. Otherwise, the cosmetic material injected under a predetermined pressure from the nozzles leaks out of the holes, and thereby the external surface of the container or the supporting block become seriously stained. Cleaning the stains decreases operation efficiency.

Furthermore, in the above described method the injection pressure should be set extremely high so as to reduce the amount of the solvent remaining after the solidification of the cosmetic material. Therefore, the cosmetic material is injected into the container at high speed, resulting in so-called jetting which often results in unevenness of color and luster of the cosmetic products after the solidification of the cosmetic material.

Accordingly, an object of the present invention is to provide a method for loading a cosmetic material into a container and solidifying the same, wherein the cosmetic material in a viscous state may be efficiently loaded into the container without any leakage thereof as experienced in the prior art.

Another object of the present invention is to provide a method of the above type which will promote solidification of the cosmetic material for shortening the process time.

A further object of the invention is the provision of a loading and solidifying method which will prevent the occurrence of jetting to thereby obtain uniform color and luster of the cosmetic material at the surface thereof.

It is still a further object of the invention to provide an apparatus which is adapted to carry out the above method.

SUMMARY OF THE INVENTION

According to the invention, a method for loading a cosmetic material into a container and solidifying the same comprises the steps of: preparing viscous cosmetic material by mixing a powder cosmetic material with a solvent; dripping a predetermined amount of the cosmetic material into a container, the container having an upper open end and a filter forming a bottom thereof; interposing a liquid absorbent membrance between the container and a presser, the presser having a dimension to fit into the container; compressing the cosmetic material by the presser with the membrance therebetween; and squeezing the solvent from the cosmetic material through the filter during the compressing step.

The container may be fitted in a supporting block which, after the container is filled with the cosmetic material, is transferred to a position below the presser. Preferably, the container is subjected to a vacuum suction through the supporting block during the compressing step.

In one embodiment of the invention, the presser is formed of a porous material so that the solvent in the cosmetic material also may be squeezed out through the presser.

An apparatus according to the invention comprises means for preparing a viscous cosmetic material and for dripping a predetermined amount of the cosmetic material into a container, the container having an upper open end and a filter forming a bottom thereof; a supporting block having formed therein a recess to hold the container in position and a passage for vacuum suction, the passage being communicated with the recess; and a presser including an inner pressing block, an outer pressing block and drive means, the inner pressing block being movable up and down relative to the outer pressing block and having a dimension to fit into the container to compress the cosmetic material, the outer pressing block enclosing the inner pressing block to abut against an upper rim of the container for preventing the cosmetic material from overflowing, and the drive means moving said inner and outer pressing blocks up and down.

Preferably, a porous support is provided to fit in the recess of the supporting block and the container is placed on the porous support.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
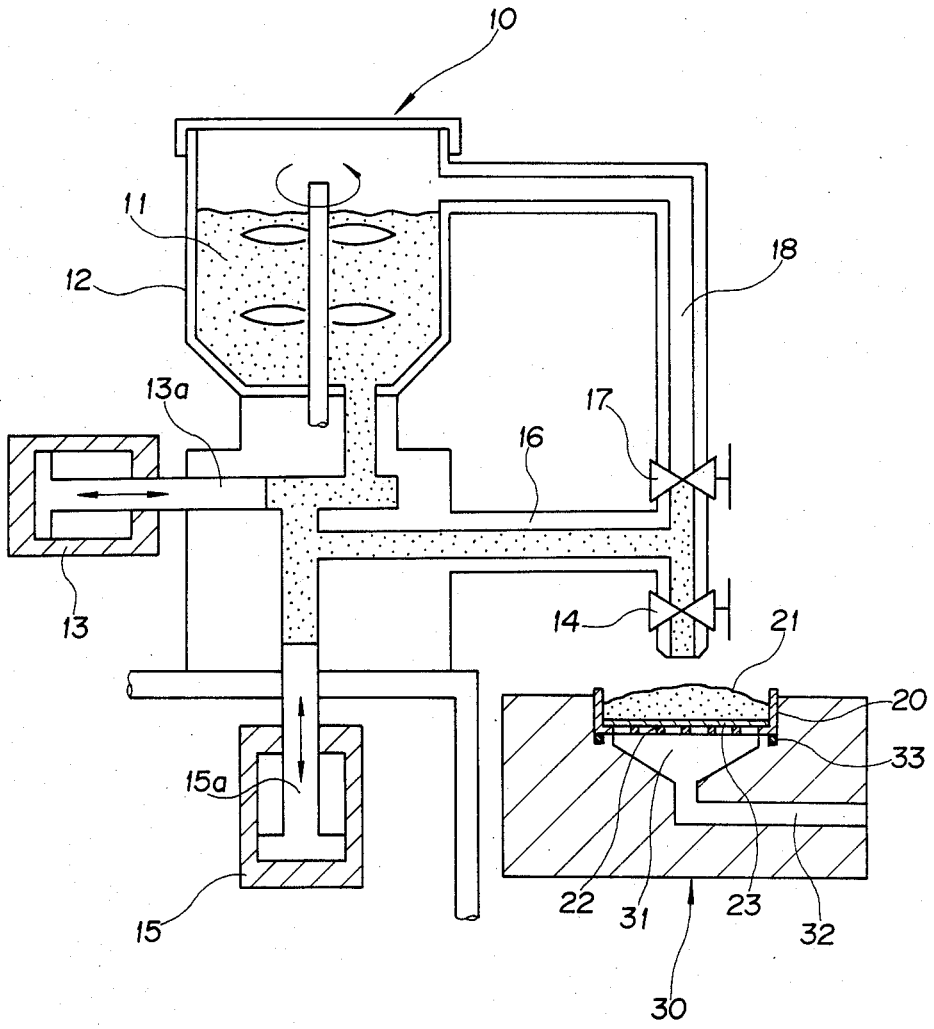
FIG. 1 is a schematic sectional view of a dispensing device and a supporting block in an apparatus according to a first embodiment of the present invention, showing a filling process of a cosmetic material into a container.

Referring to FIG. 1, a mixing tank 12 of a dispensing device 10 contains a viscous cosmetic material 11 formed by mixing powder cosmetic material with a solvent. When a piston rod 13*a* of an air cylinder 13 is at an extended position, i.e. at a right hand position in the FIGURE, an outlet of the mixing tank is closed. In that state, when a valve 14 of a tap is opened and a piston rod 15*a* of an air cylinder 15 is extended upwardly, a predetermined amount of the cosmetic material 11 in a passage 16 is gently dropped down from the tap into a container 20. By interlocking the operation of the air cylinders 13 and 15, the predetermined amount of the cosmetic material 11 can be dispensed. Further, with the valve 14 shut and a valve 17 open, the cosmetic material 11 in the mixing tank 12 is circulated through passages 16 and 18 in order to render uniform the viscosity of the cosmetic material 11.

Figure 5:
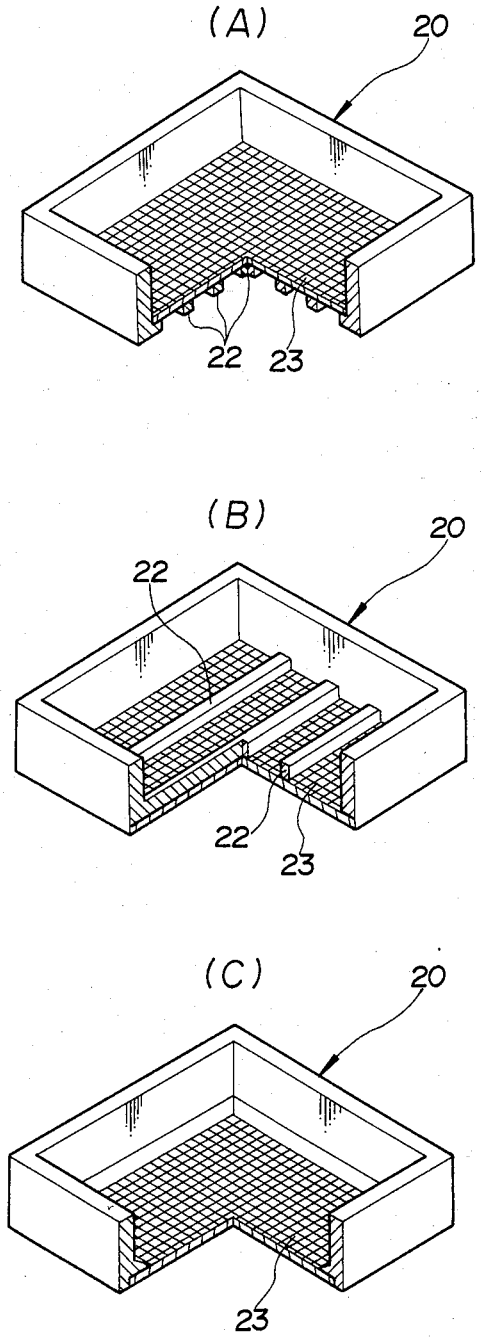
FIGS. 5 (A) to (C) are perspective views, partly broken away, illustrating three examples of the container to be filled with the cosmetic material.

In FIG. 5 (A) is shown the container 20 in FIG. 1. The container 20 is shaped like a shallow dish with a bottom having ribs 22 on which a filter 23 is placed. The filter 23 may be made of liquid absorbent paper, woven cloth, unwoven cloth, or knitted cloth. The frame and ribs 22 of the container may be made of plastics, and the filter 23 may be fitted therein at the time of plastic molding. The ribs 22 are separated from each other to provide open spaces therebetween.

A supporting block 30 includes a recess 31 which snugly receives the container 20. The recess 31 has a funnel-shaped space which is connected to a passage 32 for vacuum suction. A packing 33 is provided in a periphery of the recess bottom for forming an air-tight fit with the container 20.

Figure 2:
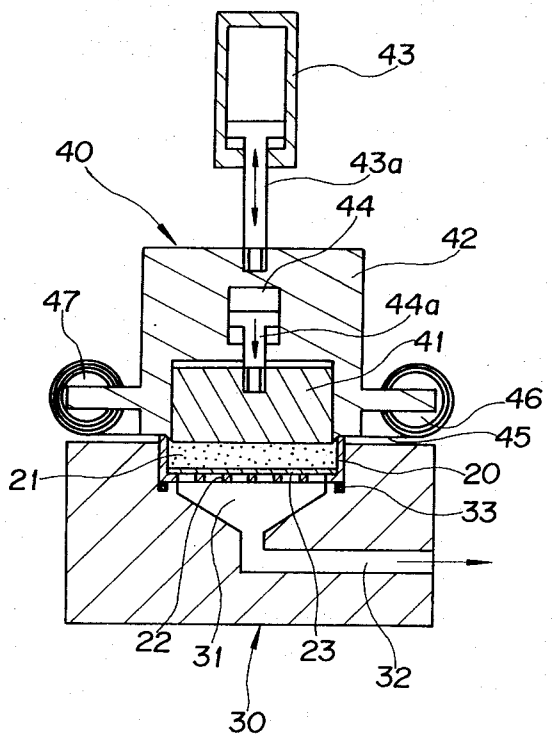
FIG. 2 is a schematic sectional view of the supporting block shown, in FIG. 1, combined with a presser for a process of pressing and solidifying the cosmetic material.

First, the container 20 is placed on the recess 31 and then the supporting block 30 is transferred by, for example, a conveyor until the container 20 is located under the tap of the dispensing device 10. Thereafter, the predetermined amount of the cosmetic material designated by numeral 21 is gently dripped down from the tap as described above. Then the supporting block 30 with the container 20 fitted thereto is transferred in order to be subjected to a forming and solidifying process, and is combined with a presser 40 as shown in FIG. 2. The passage 32 is then connected to a vacuum pump (not shown).

The presser 40 comprises an inner pressing block 41 which fits into the container 20 on the supporting block 30 in order to press the cosmetic material 21 in the container, an outer pressing block 42 which surrounds the inner pressing block and rests against an upper rim of the container 20 in order to prevent the cosmetic material 21 from overflowing, and air cylinders 43 and 44 which respectively move the inner and outer pressing blocks up and down. The air cylinder 44 is situated inside the outer pressing block 42 and its piston rod 44*a* is connected to the inner pressing block 41. Accordingly, by the action of piston rod 44*a*, the inner pressing block 41 can be moved up and down in relation to the outer pressing block 42. Further, the air cylinder 43 connects the outer pressing block 42 with a fixed member (not shown), and by the action of a piston rod 43*a*, the outer pressing block 42 as well as the inner pressing block can be moved up and down.

A supplier 46 for a roll of liquid absorbent membrance 45 is situated on one side of the outer pressing block and a winder 47 for the same roll is situated on the other side thereof. The roll of absorbent membrance 45, which may be made of paper or cloth, is pulled out from the supplier 46, led through the underside of the presser 40, and wound by the winder 47.

The forming and solidifying process will be described hereinafter. The supporting block 30 and the presser 40 are first placed in position with the inner and outer pressing blocks raised apart from the supporting block 30. Then by the action of the air cylinder 43, the outer pressing block 42 is moved down until the absorbent membrance 45 is applied to the underside of the presser 40 and until the rim of the container 20 abuts the lower surface of the block 42 so that the container 20 is secured in position by the outer pressing block 42 with the absorbent membrance interposed therebetween them.

Thereafter, by the action of the air cylinder 44, the inner pressing block 41 is moved down until the underside thereof fits into the container 20 and presses down the cosmetic material 21 with the absorbent membrance 45 interposed therebetween. Thus the cosmetic material is compressed and shaped in accordance with a configuration of the container 20 and the underside of the inner pressing block 41.

During the compression process of the cosmetic material 21, the solvent contained in the cosmetic material is squeezed out through the filter 23 and the spaces between the ribs 22 and is then dropped into the recess 31 of the supporting block 30. The recess 31 of the supporting block 30, connected to a vacuum pump through the passage 32, is subjected to vacuum suction. Accordingly, the squeezed-out solvent is subjected to vacuum suction and is discharged outwardly. Further, a part of the solvent in the cosmetic material 21 is also absorbed into the absorbent membrance 45. Thus, the cosmetic material 21 in the container 20 is rapidly dried and solidified.

After the process of loading and solidifying the cosmetic material, the presser 40 is raised apart from the cosmetic material and the container 20 is taken out of the supporting block 30. Then, the absorbent membrance 45 is wound by the winder 47 for a predetermined length so that an unused part of the absorbent membrance will be ready for the next cycle.

Figure 3:
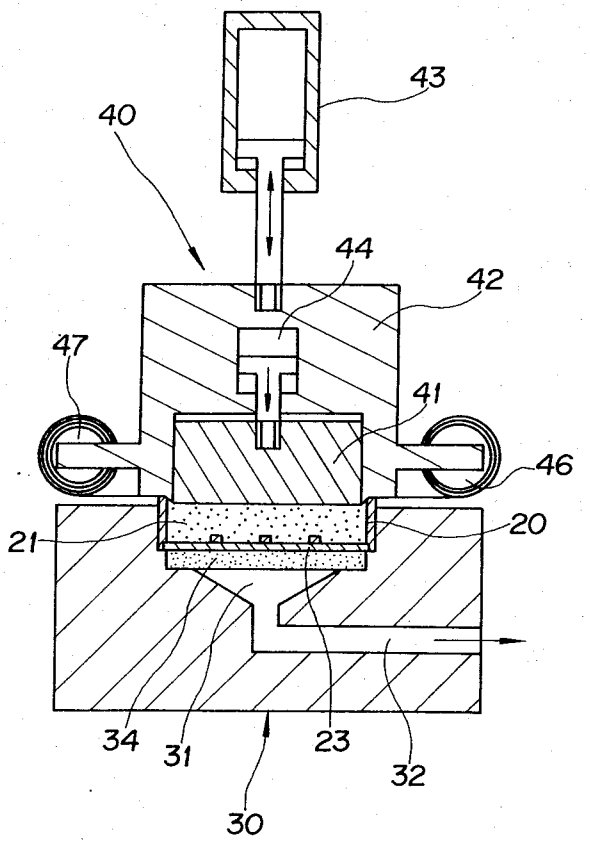
FIG. 3 is a view similar to FIG. 2 with a supporting block according to another embodiment of the present invention.

FIG. 3 shows a second embodiment of the present invention which differs from the embodiment as shown in FIGS. 1 and 2 in that a porous support 34 is provided in the bottom of the recess 31 to support the container 20. The porous support 34 may be formed of an absorbent porous plate which is preferably formed by sintered metals, ceramics or the like so as to have a sufficient mechanical strength. When the inner pressing block 41 compresses the cosmetic material 21, such pressure is not supported by the ribs 22 or the filter 23 of the container 20 but up the porous support 34. The solvent in the cosmetic material is sucked out by vacuum suction through the porous support 34 and the passage 32.

Since the porous support 34 holds the bottom of the container 20, the pressure applied to the cosmetic material 21 by the inner pressing block 41 can be increased, which facilitates the shaping and solidifying of the cosmetic material. Further, as there is no need for consideration of the mechanical strength of the ribs 22 and the filter 23 of the container 20, the ribs may be made much thinner or dispensed with.

Details of the container 20 in FIG. 3 are shown in FIG. 5 (B). The container 20 has the ribs 22 on the upper surface of the filter 23. In this case, the ribs 22 are embedded in the cosmetic material 21 in the container 20 so that they prevent the cosmetic material from dropping out of the container. The container 20 in FIG. 5 (C) includes a bottom filter 23 without any ribs. In this structure, the container 20 can be made thinner without any reduction of its volume.

Figure 4:
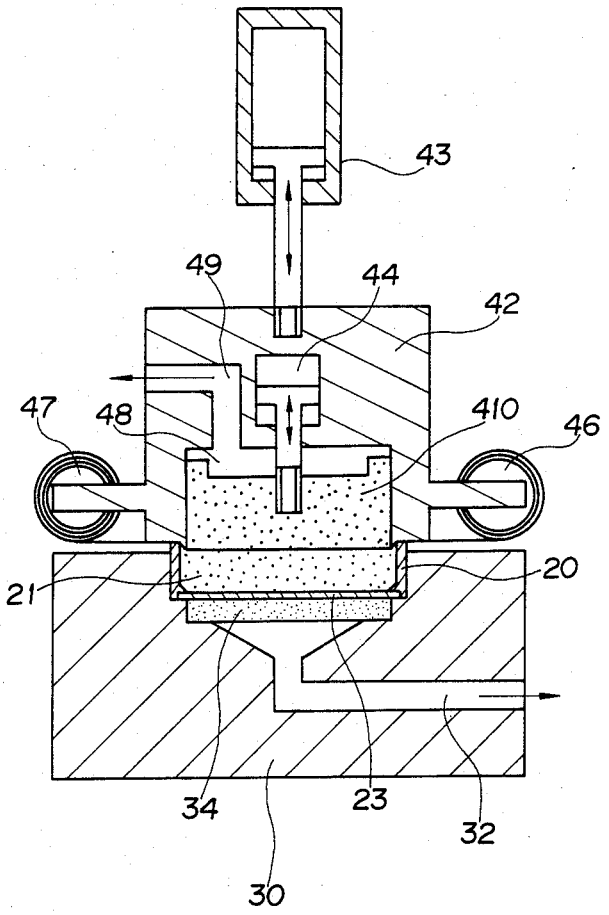
FIG. 4 is also a view similar to FIG. 3 with a presser according to still another embodiment of the present invention.

FIG. 4 shows a third embodiment of the present invention in which an inner pressing block 410 corresponding to the inner pressing block 41 in FIGS. 2 and 3, is made of porous material, a space 48 is defined between the inner and outer pressing blocks 42 and 410, and the space 48 is connected via a passage 49 to a vacuum pump (not shown).

The porous block 410 may be made of the same material as the above porous support 34. When the inner pressing block 410 compresses the cosmetic material 21, the solvent is squeezed out through the absorbent membrance 45 into the inner pressing block 410 and discharged by vacuum suction through the space 48 and the passage 49. Therefore, the solvent is sucked and squeezed out from both the top and bottom surfaces of the cosmetic material 21 so that the cosmetic material 21 may be solidified faster to thereby further shorten the process time. The container in FIG. 5 (C) is used for this embodiment, and the porous support 34 is provided in the bottom of the recess 31.

As it will be understood from the foregoing description, according to the invention the cosmetic material in a viscous state can be loaded into the container without any fear of staining the container or apparatus. Also, the cosmetic material is shaped by the compression of the presser, and at the same time the solvent in the cosmetic material is swiftly squeezed out so that cracks or sink marks will not develop in the surface of the cosmetic material after solidification thereof, which results in a beautiful external appearance of the cosmetic material. Furthermore, loading of the cosmetic material according to the present invention is free from jetting that tends to create uneven color or luster of the material as experienced in the prior art.

Although the present invention has been described with reference to the preferred embodiments thereof, many modifications and alternations may be made within the spirit of the invention.

What is claimed is:

1. A method for loading a cosmetic material into a container and solidifying said cosmetic material, comprising the steps of:

preparing a viscous cosmetic material by mixing a powder cosmetic material with a solvent;

dripping a predetermined amount of said viscous cosmetic material into a container, said container having an upper open end and a filter forming a bottom thereof;

interposing a liquid absorbent membrance between said container and a presser, said presser having a dimension to fit into said container;

compressing said cosmetic material by said presser with said membrance therebetween; and squeezing said solvent from said cosmetic material through said filter during said compressing step.

2. A method as claimed in claim 1, wherein said container is fitted in a supporting block, said supporting block, after said container is filled with said cosmetic material, being transferred to a position below said presser.

3. A method as claimed in claim 2, wherein said container is subjected to a vacuum suction through said supporting block during said compressing step.

4. A method as claimed in claim 2, wherein said supporting block includes fitted therein a porous support to hold said container therein, said porous support being subjected to a vacuum suction during said compressing step.

5. A method as claimed in claim 1, wherein said presser comprises an outer pressing block and an inner pressing block, and said compressing step includes the steps of abutting said outer pressing block against an upper rim of said container and then lowering said inner pressing block to compress said cosmetic material.

6. A method for loading a cosmetic material into a container and solidifying said viscous cosmetic material, comprising the steps of:

preparing a viscous cosmetic material by mixing a powder cosmetic material with a solvent;

dripping a predetermined amount of said viscous cosmetic material into a container, said container having an upper open end and a filter forming a bottom thereof;

interposing a liquid absorbent membrance between said container and a presser, said presser having a dimension to fit into said container and being formed of a porous material;

compressing said cosmetic material by said presser with said membrance therebetween; and squeezing said solvent from said cosmetic material through said filter and through said presser during said compressing step.

7. A method as claimed in claim 6, wherein said presser has formed therein a hollow space for vacuum suction.

8. An apparatus for loading a cosmetic material into a container and solidifying said cosmetic material, said apparatus comprising:

means for preparing a viscous cosmetic material and for dripping a predetermined amount of said cosmetic material into a container, said container having an upper open end and a filter forming a bottom thereof;

a supporting block having formed therein a recess to hold said container in position and a passage for vacuum suction, said passage being communicated with said recess;

a presser including an inner pressing block formed of porous material, an outer pressing block, a hollow space and drive means, said inner pressing block being movable up and down relative to said outer pressing block and having a dimension to fit into said container to compress said cosmetic material, said outer pressing block enclosing said inner pressing block to abut against an upper rim of said container for preventing said cosmetic material from overflowing, said hollow space being defined between said inner and outer pressing blocks for applying vacuum suction to said inner pressing block, and said drive means moving said inner and outer pressing blocks up and down; and a liquid absorbent membrane interposed between said supporting block and said presser.

9. An apparatus as claimed in claim 8, further comprising a porous support fitted in said recess of said supporting block, said container being placed on said porous support.

10. An apparatus as claimed in claim 8, wherein said liquid absorbent membrane extends between a pair of feeding rollers.

11. An apparatus as claimed in claim 8, wherein said drive means comprises a first air cylinder connected to said outer pressing block and a second air cylinder connected to said inner pressing block, said second air cylinder being disposed within said outer pressing block.

* * * * *